US011646507B2

(12) United States Patent
Carlsson

(10) Patent No.: US 11,646,507 B2
(45) Date of Patent: May 9, 2023

(54) ELECTRICAL CONNECTOR

(71) Applicant: INUHEAT GROUP AB, Hovås (SE)

(72) Inventor: Stefan Carlsson, Bjärred (SE)

(73) Assignee: INUHEAT GROUP AB, Hovås (SE)

( * ) Notice: Subject to any disclaimer, the term of this patent is extended or adjusted under 35 U.S.C. 154(b) by 0 days.

(21) Appl. No.: 17/258,644

(22) PCT Filed: Jul. 10, 2019

(86) PCT No.: PCT/SE2019/050687
§ 371 (c)(1),
(2) Date: Jan. 7, 2021

(87) PCT Pub. No.: WO2020/018009
PCT Pub. Date: Jan. 23, 2020

(65) Prior Publication Data

US 2021/0273349 A1 Sep. 2, 2021

(30) Foreign Application Priority Data

Jul. 16, 2018 (SE) ..... 1850907-5

(51) Int. Cl.
*H01R 12/68* (2011.01)
*H01R 4/06* (2006.01)
(Continued)

(52) U.S. Cl.
CPC ..... *H01R 4/06* (2013.01); *A41D 1/005* (2013.01); *H01R 9/20* (2013.01); *H01R 12/68* (2013.01)

(58) Field of Classification Search
None
See application file for complete search history.

(56) References Cited

U.S. PATENT DOCUMENTS 1,585,849 A 5/1926 Gindre
3,438,232 A 4/1969 Achler et al.
(Continued)

FOREIGN PATENT DOCUMENTS

GB 123770 A 5/1920
JP 2013158353 A 8/2013
(Continued)

OTHER PUBLICATIONS

International Search Report and Written Opinion from corresponding International Application No. PCT/SE2019/050687, dated Aug. 9, 2019, 9 pages.
(Continued)

*Primary Examiner* — Felix O Figueroa
(74) *Attorney, Agent, or Firm* — Tucker Ellis LLP

(57) ABSTRACT

An electrical connector includes a male element and a female element configured to form a rivet for fastening the electrical connector to a piece of material; and a neck washer, which has a washer portion and a neck portion and which is configured to be placed between the male element and the female element of the rivet. The washer portion is configured to form an electrical connection area for an electrical conductor of the piece of textile and the neck portion is configured to electrically connect the washer portion to at least one of the male element and the female element. The electrical connector can be used independently of the position of the electrical conductor in relation to one or more layers of materials in the piece of material.

19 Claims, 3 Drawing Sheets

(51) Int. Cl.
*A41D 1/00* (2018.01)
*H01R 9/20* (2006.01)

(56) References Cited

U.S. PATENT DOCUMENTS

| | | | | |
|---|---|---|---|---|
| 3,548,264 | A | 12/1970 | Carino et al. | |
| 5,003,673 | A | 4/1991 | Bernhard | |
| 5,312,269 | A * | 5/1994 | Hwang | H01R 11/281 439/500 |
| 6,170,135 | B1 * | 1/2001 | Pferdehirt | A44B 17/007 24/687 |
| 6,951,467 | B1 * | 10/2005 | Hansen | H01R 4/06 439/82 |
| 9,642,398 | B1 * | 5/2017 | Mason | A41D 1/005 |
| 2012/0193342 | A1 | 8/2012 | Macher | |
| 2017/0112200 | A1 | 4/2017 | Mason et al. | |

FOREIGN PATENT DOCUMENTS

| | | | |
|---|---|---|---|
| KR | 20140005669 | A | 1/2014 |
| WO | 2016072925 | A1 | 5/2016 |

OTHER PUBLICATIONS

Supplementary European Search Report from corresponding European Application No. 19837604, dated Feb. 25, 2022, 2 pages.

* cited by examiner

ELECTRICAL CONNECTOR

TECHNICAL FIELD

The current invention relates to an electrical connector, which is suitable for use in active garments and other active products.

BACKGROUND ART

An active garment or other active product (in the following sometimes only referred to as active garment) may be defined as a garment having an added functionality compared to a traditional garment. The added functionality may include heating by heating elements, cooling by cooling elements and measurement of body functions by sensor elements incorporated in the garment. These active elements are generally powered and controlled from a power unit which is carried on the active garment and which is connected to electrical terminals on the active garment. The electrical terminals connect the power unit to the active elements via electrical conductors incorporated in the active garment.

An active garment may include one or more layers of fabrics. Normally it is desirable to have the power unit and thus the electrical terminals for connecting the power unit on the outside of the outmost layer or the inside of the innermost layer where the power unit is easily available for a user. However, if the electrical conductors are not accessible on the side of the fabric where the power unit is to be connected, but for instance run between two layers of fabrics, a special solution is needed in order to connect the electrical conductors to electrical terminals that are accessible to the power unit. The connection solution also needs to be easily assembled in manufacturing processes and still resistant to attrition, applied forces, sweat and washing.

WO 2016/072925 shows a holding element which is intended to be affixed to an active article of clothing at two spaced apart locations. It is provided with first electrical terminals for connection to an activation unit, which is to be secured to the article of clothing by the holding element, second electrical terminals for connection to a functional component of the active article of clothing and electrically conductive paths between the first and second terminals, the second electrical terminals being placed where the holding element is intended to be affixed to the article of clothing and making contact with electrically conductive material in the article of clothing. This solution presupposes that the electrical conductors are accessible at the two spaced apart locations where the holding element is to be affixed to an article of clothing.

US 2012/0193342 shows an electrically heatable sock with a heating element disposed on the foot part. The heating element is connected via supply lines to terminals for a voltage supply in the upper part of the sock. The terminals are arranged on a carrier which may be sewn on the cuff of the heatable sock. This solution presupposes that the electrical conductors are accessible at the outside of the sock so that they can be connected to the terminals on the carrier.

SUMMARY

It is an objective of the invention to at least partly overcome one or more limitations of the prior art.

Another objective is to provide an electrical connector which is suitable for connecting one or more electrical conductors in an active garment or other active product to one or more electrical terminals of a power unit, control unit or similar unit independently of the position of the electrical conductor(s) in relation to one or more layers of fabrics or other material in the active garment.

One or more of these objectives, as well as further objectives that may appear from the description below, are at least partly achieved by an electrical connector according to the independent claim, embodiments thereof being defined by the dependent claims.

According to one aspect of the invention, an electrical connector comprises a male element and a female element configured to form a rivet for fastening the electrical connector to a piece of material and a neck washer, which has a washer portion and a neck portion and which is configured to be placed between the male element and the female element of the rivet, wherein the washer portion of the neck washer is configured to form an electrical connection area for an electrical conductor of the piece of material and the neck portion of the neck washer is configured to electrically connect the washer portion to at least one of the male element and the female element.

If an active product includes two or more layers of material and an electrical conductor runs between the layers, the neck washer may be placed between the male element and the female element so that its washer portion extends between the relevant layers of material and provides a connection area for the electrical conductor. Thus the electrical connector can be used even if the electrical conductor is not accessible on the outside of the active product.

Still other objectives, features, aspects and advantages of the present invention will appear from the following detailed description, from the attached claims as well as from the drawings.

BRIEF DESCRIPTION OF DRAWINGS

Embodiments of the invention will now be described in more detail with reference to the accompanying schematic drawings.

DETAILED DESCRIPTION OF EXAMPLE EMBODIMENTS

Figure 1:
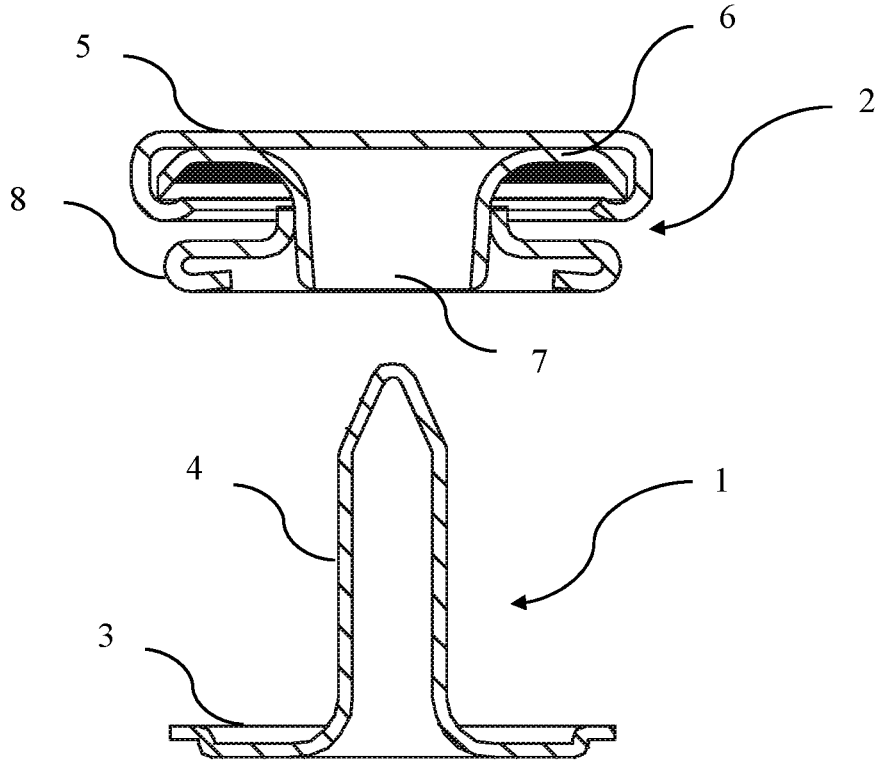
FIG. 1 PRIOR ART
FIG. 1 shows a cross section of a rivet, commonly used as a button in jeans, in a non-riveted state.

Riveting is a common method within the field of ready-made clothing. It is used to hold together layers of fabrics, to re-enforce stress points and to fasten buttons, typically in jeans. FIG. 1 shows a cross section of a common type of rivet used for jeans buttons. It has a male element 1 and a female element 2. The male element 1 has the general shape of a nail with a head 3 and a pointy pin 4. The female element 2 constitutes the button and has a cap 5, a cylindrical neck 6 with an opening 7, and a support part 8 which forms a support area against the jeans fabric. When fastening the rivet in the jeans, the pointy end of the nail 1 is stuck through the jeans fabric. Then a tool is used to squeeze the nail 1 and the button 2 together so that the pin 4 of the nail enters the opening 7 in the cylindrical neck 6. The pin 4 is deformed in the female element 2 so that a permanent joint is created.

Figure 2:
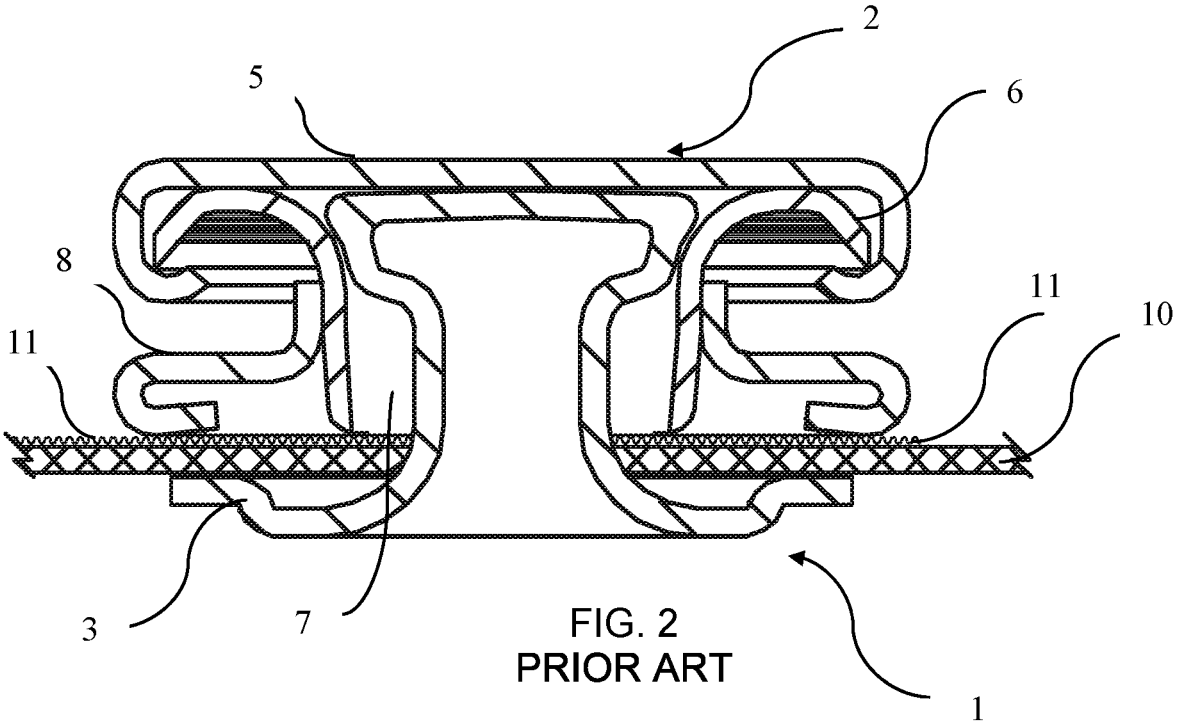
FIG. 2 PRIOR ART
FIG. 2 shows a cross section of the button of FIG. 1 in a riveted state.

If at least one part of the rivet is electrically conductive, it could be used as an electrical connector, which is further illustrated in FIG. 2.

In FIG. 2, a rivet or electrical connector of the same type as shown in FIG. 1 is riveted in a piece of fabric 10 which is held between the male element 1 and the female element 2 of the rivet. An electrical conductor 11 runs on the top of the fabric 10 and makes contact with the underside of the support part 8 and the bottom of the neck. If the female element 2 is electrically conductive, an electrical current can flow from the electrical conductor 11 to the cap 5 and further on to an electrical terminal (not shown) in contact with the cap 5 or vice versa.

If instead the conductor 11 would run on the underside of the piece of fabric 10, it would make contact with the head 3 of the male element 1 and if both the male element 1 and the female element 2 are electrically conductive, current can flow from the male element 1 to the cap 5 of the female element 2 and further on to an electrical terminal (not shown) in contact with the cap 5 or vice versa.

However, if there are two layers of fabrics 10 between the elements 1, 2 of the rivet and the conductor 11 runs on the underside of the top layer or on the top of the bottom layer, i.e. between the two layers, the conductor neither contacts the female element 2, nor the head 3 of the nail 1, and the contact area between the conductor 11 and the pin 4 of the male element 1 is insufficient to reliably transfer current between the conductor 11 and the electrical connector.

Figure 3:
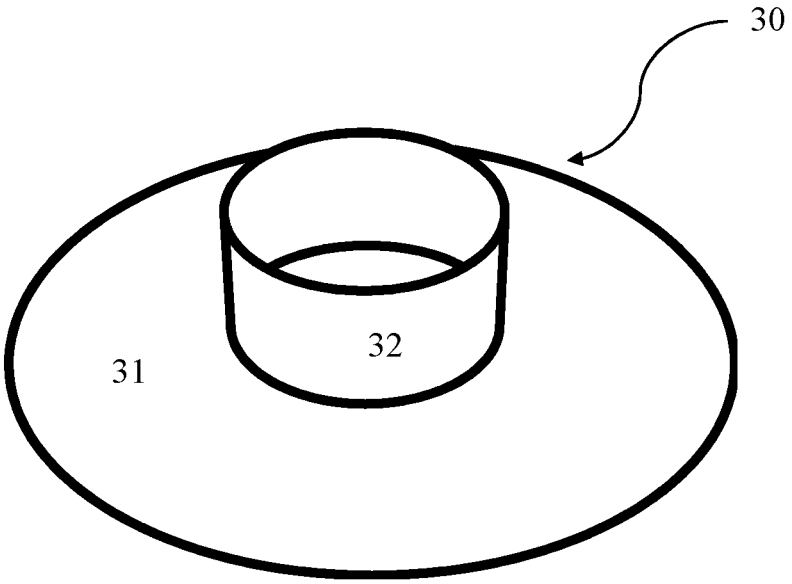
FIG. 3 shows an embodiment of a neck washer.

To solve this problem, an electrical connector, which has a male element 1 and a female element 2 configured to from a rivet for fastening the electrical connector to a piece of material, is further provided with a neck washer 30, an embodiment of which is schematically shown in FIG. 3.

The neck washer 30 has a washer portion 31 which is configured to form a connection area for an electrical conductor and a neck portion 32 which is configured to electrically connect the washer portion 31 to either the male element 1 or the female element 2 of the electrical connector, or both. In the embodiment shown in FIG. 3, the washer portion 31 extends radially from the cylindrical neck portion 32 to form a circular connection area for the electrical conductor. In other embodiments, the washer portion 31 and the neck portion 32 may be differently shaped. They need not be symmetrical but may have an irregular shape, and they need not be continuous but may consist of several parts. The sizes of the neck portion and the washer portion may vary. Also, the neck washer may be made in one piece. It may have a rounded transition between the washer portion 31 and the neck portion 32. The angle between the neck portion and the washer portion may vary, but generally the washer portion 31 may extend in the transverse direction from the neck portion 32.

The neck washer 30 is configured to be placed between the male element 1 and the female element 2 of the rivet. For that purpose, the inner diameter of the neck portion 32 may be larger than the outer diameter of the pin 4 so that the neck washer can be placed on the pin 4 of the male element 1. Also, in some embodiments, the outer diameter of the neck portion 32 may be smaller than the inner diameter of the opening 7 in the female element 2 so that the neck portion may extend into the opening 7 and be accommodated in the opening 7. Alternatively, the neck portion 32 may be deformable so that the neck washer can be placed on the pin 4 and/or extend into the opening 7. Depending on the number of layers of fabrics the electrical connector is riveted in and depending on where the electrical conductor is running in relation to these layers of fabrics, the neck washer 30 can be differently located in relation to the layers of fabrics. Thus, when fastening the electrical connector, the male element 1 may first be stuck through only one or some of the layers of fabrics, then the washer 30 placed on the pin 4 of the male element 1 so that the washer portion 31 makes contact with the electrical conductor 11 either at its lower side or at its upper side, and then the male element 1 is stuck through the remaining layer(s) of fabrics before being squeezed together with the female element 2.

Figure 4:
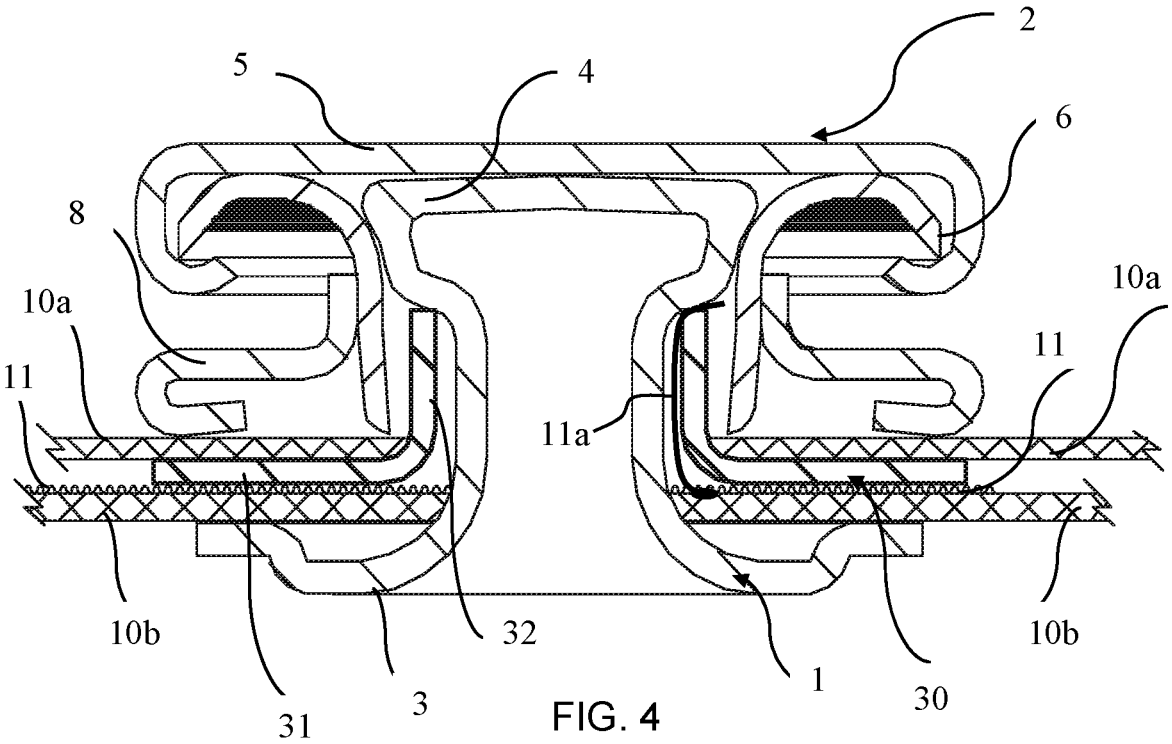
FIG. 4 shows a cross section of a first embodiment of an electrical connector in the riveted state.

FIG. 4 shows an example where the rivet-type electrical connector is fastened in two layers of fabrics 10*a*, 10*b* and an electrical conductor 11 runs on the upper side of the bottom layer 10*b*. The pin 4 of the male element extends through both layers of fabric into the female element 2 and makes contact with the female element. The neck washer 30 is placed on the pin 4 of the male element 1 with the washer portion 31 extending between the layers of fabric 10*a*, 10*b* transversely from the pin 4. The neck portion 32 extends in the longitudinal direction of the pin 4 of the male element 1 and makes contact with the inside of the female element 2 and the outside of the pin 4 of the male element 1. It should be mentioned that FIG. 4 shows gaps between the neck portion 32 of the neck washer 30 and the outside of the pin 4 of the male element 1 and the inside of the neck part 6 of the female element 2, respectively. These gaps are solely for illustrative purposes to make the figure clearer. In a real electrical connector, the neck portion 32 of the neck washer 30 will be in close contact with the inside of the neck part 6 of the female element 2 in the riveted state and optionally also with the outside of the pin 4 of the male element 1. The washer portion 31 of the neck washer 30 forms a connection area for the conductor 11 on the upper side of the bottom layer 10*b* of the fabric. Current can flow from the conductor 11 through the washer portion 31, the neck portion 32, to the female element 2 and its cap 5, or vice versa. In this example, only the female element 2 and the neck washer 30 need to be made from electrically conductive material. The male element 1 could be of non-conductive material, e.g. plastic. It may, however, also be of electrically conductive material. A male element 1 of plastic may lead to lowered cost for the electrical connector and increased comfort for a user of an active garment.

Figure 5:
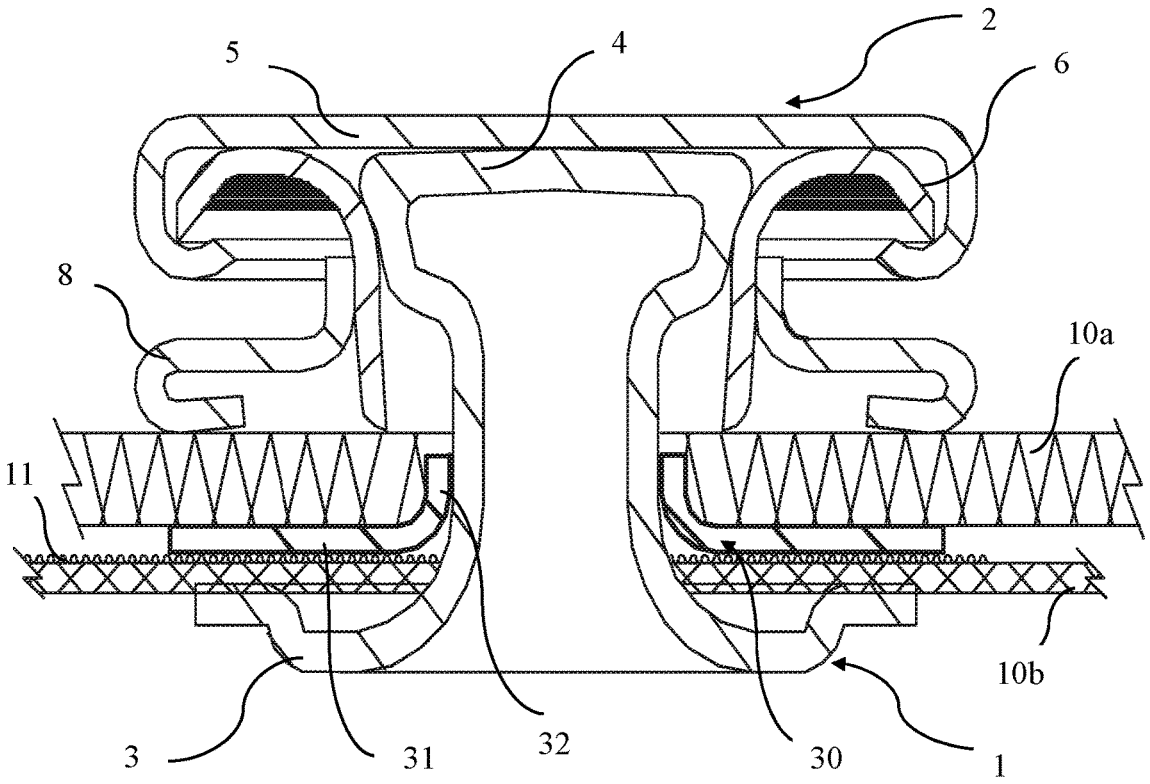
FIG. 5 shows a cross section of a second embodiment of an electrical connector in the riveted state.

FIG. 5 shows another embodiment of the electrical connector where the neck washer 30 has a shorter neck portion 32 compared to the neck portion of the neck washer in FIG. 4. In this embodiment, the neck portion 32 of the neck washer 30 does not extend into the opening 7 of the female element 2. It connects only with the male element 1 in the riveted state. Current can flow from the conductor 11 through the washer portion 31 and the neck portion 32 of the neck washer 30 to the male element 1 and further on to the female element 2 and its cap 5, or vice versa. The male element 1, the neck washer 30 and the female element 2 need all be electrically conductive. A neck washer 30 with a shorter neck portion 32 need not be stuck through as many layer of fabrics as a neck washer with a longer neck portion 32. A longer neck portion 32 may on the other hand lead to fewer electrical connection points.

In the embodiments of FIGS. 4 and 5, the cap 5 of the female element 2 of the electrical connector forms an electrical terminal. As an alternative, it is of course possible to use the head 3 of the male element 1 of the electrical connector as an electrical terminal that is to connect to an electrical terminal of another device. In such case, the electrical connector can be fastened so that the head 3 is placed on the outside of the garment or in another location where it should be available. In such case, the female element 2 may be formed of non-conductive material.

Figure 6:
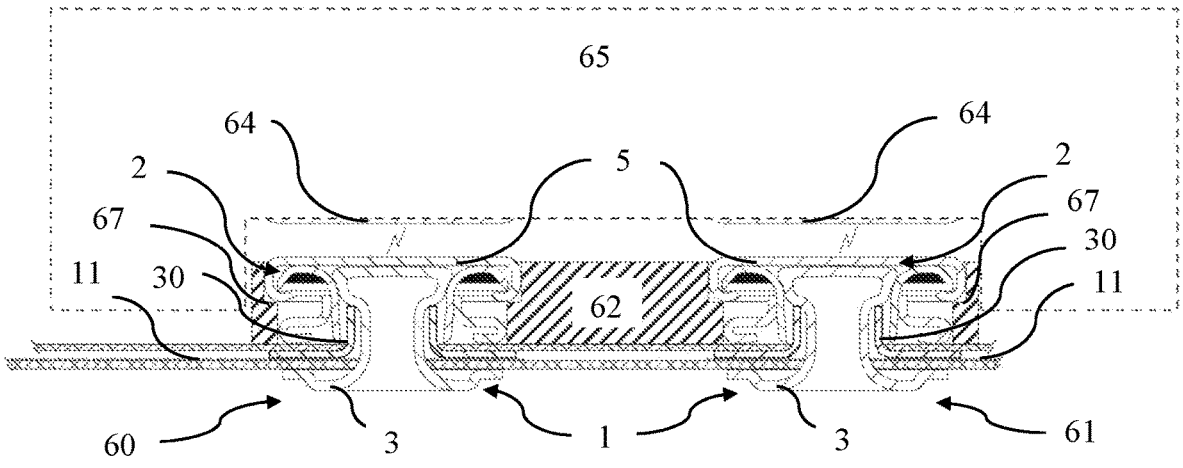
FIG. 6 shows a cross section of a third embodiment of an electrical connector in the riveted state with a power unit connected to it.

FIG. 6 shows an electrical connector having two connector elements 60, 61 formed by two rivets of the same kind as shown in FIG. 4. More particularly, a first connector element 60 comprises a first male element 1, a first female element 2 and a first neck washer 30, and a second connector element 61 comprises a second male element 1, a second female element 2 and a second neck washer 30. The two connector elements 60, 61 are held at a fixed distance from each other by means of a spacer 62, which is schematically shown in FIG. 6. The spacer may have a first and a second opening for the first and second connector element 60, 61, respectively. The first and second openings may have a first diameter and a second smaller diameter so that a supporting ledge 67 is formed around the wall of each one of the openings. The first and second diameters may be adapted to the diameter of the caps 5 of the female elements 2, so that the undersides of the caps 5 may rest against the ledge 67, thereby to hold the female elements 2 in the openings of the spacer 62. In some embodiments, the electrical connector may also comprise a second spacer (not shown) which may be placed in the corresponding way on the underside of the electrical connector, i.e. on the underside of the piece(s) of textile when the electrical connector is in the riveted state. The second spacer may have a first and second opening for the male elements 1 of the connector elements 60, 61. The openings of the second spacer may also have a first diameter and a second smaller diameter so that a supporting ledge is formed around the walls of each one of the openings. The diameters may be adapted to the diameter of the heads 3 of the male elements 1, so that the upper side of the heads 3 of the male elements 1 may rest against the respective ledge, thereby to hold the male elements 1 in the openings of the spacer. The purpose of the one or two spacers is to hold the electrical connector elements 60, 61 at a fixed distance to each other and to take up shear forces.

The electrical connector illustrated in FIG. 6 may be connected, via the neck washers 30, to a respective electrical conductor 11 in a piece of textile, and, via the caps 5, to two electrical terminals 64 of another device 65 which is schematically shown in FIG. 6 by broken lines at a distance from the two electrical connector elements 60, 61. The other device may be a power source that provides power to a functional component (heating element, cooling element, sensor or the like) of the active garment. It may also be a control device that provides control signals to the functional component or a combination of a power source and a control unit. The caps may also be configured to hold the power unit 64 by a mechanical grip, by a friction force or by a magnetic force.

The neck washer 30 shown in FIG. 6 may be replaced by a differently designed neck washer, e.g. the one shown in FIG. 5.

As has already been mentioned above, the electrical connector may be used in active garments, such as socks, gloves, underwear, jackets, pants, sweaters, sports clothing, caps and all other kinds of garments, and in other active products. A mentioned, the active garment and the other active products may include layers of fabrics. In some embodiments, they may include layers of other textile materials or layers of other soft materials, like silicone or neoprene, or layers of other materials in which the electrical connector can be fastened. Generally the electrical connector is suitable for any piece of material in which a rivet can be fastened. Example of other active textile products include actively heated/cooled blankets, belts and heat pads. Examples of sensors included in active garments and other active products comprise pedometers, heart rate monitors, temperature sensors and similar devices.

The electrical connector has been illustrated in the drawings with a male element and a female element of a specific design. However, it should be understood that rivets exist in a multitude of designs and the design of the male element and the female element may therefore vary to a large extent depending on the specific use of the electrical connector. The shape, the size and the material of the male and female elements may vary and they may consist of a single part or an assembly of two or more parts. The important aspect is that the male element and the female element are configured to form a rivet for fastening the electrical connector to a piece of material.

The electrical conductor 11 may be integrated in one of the layers of the piece of material to which the electrical connector is fastened. It may for instance be knitted or woven into a layer of fabric. The electrical conductor 11 may alternatively be attached to the layer of material. It may for instance be sewn or embroidered onto a layer of fabric. As shown in FIG. 4, in some embodiments, an end 11*a* of the electrical conductor 11 may be loose. This loose end 11*a* may be folded upwards into the neck portion 32 of the neck washer 30 so that it is clamped between the neck portion 32 and the pin 4 of the male element 1. In this case, also the neck portion 32 will form an electrical connection area for the electrical conductor 11.

As mentioned, the cap 5 of the female element 2 and the head 3 of the male element 1 of the electrical connector may be used as an electrical terminal. The cap 5 and/or the head 3 may additionally be configured and shaped as a fastening element to hold a matching fastening element of another device by mechanical grip, friction force, magnetic force or any other suitable means.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. An electrical connector system comprising:

a piece of material extending generally along a lateral direction;

a male element;

a female element, wherein the male element and the female element are configured to form a rivet for fastening to the piece of material; and a neck washer, having a washer portion and a neck portion, wherein the neck washer is monolithic so that the washer portion and the neck portion are physically interconnected, and wherein the neck washer is configured to be placed between the male element and the female element of the rivet, wherein the neck washer forms an electrical connection area configured to make electrical connection with a loose end of an electrical conductor of the piece of material that extends out of the piece of material along a longitudinal direction perpendicular to the lateral direction;

wherein, with the neck washer placed between the male element and the female element of the rivet:

the washer portion extends radially away from the male element and the neck portion, and the neck portion extends in the longitudinal direction from an opening in the piece of material through which the male element extends toward the female element, is radially inward of the washer portion and radially outward of the male element of the rivet, and is arranged directly between the male element and an innermost radial surface of the female element in the lateral direction; and wherein the neck portion of the neck washer is configured to electrically connect the electrical conductor to at least one of the male element and the female element.

2. The electrical connector system of claim 1, wherein the male element comprises a pin, and the neck washer is configured to be placed on the pin of the male element.

3. The electrical connector system of claim 1, wherein the female element has an opening for the male element, and the neck portion of the neck washer is configured to be accommodated in the opening.

4. The electrical connector system of claim 1, wherein the male element consists of an electrically non-conductive material.

5. The electrical connector system of claim 1, wherein one of the male element and the female element is configured to form an electrical terminal to be connected to an electrical terminal of another device.

6. The electrical connector system of claim 1, wherein the male element, the female element and the neck washer form a first connector element for the electrical conductor of the piece of material, and the electrical connector system further comprising:

a second male element, a second female element, a second neck washer, wherein the second male element, the second female element and the second neck washer form a second connector element for a second electrical conductor of the piece of material, and a spacer comprising a first opening and a second opening for respectively accommodating the female elements of the first and second connector elements, the first and second openings being a fixed distance from each other.

7. The electrical connector system of claim 1, wherein the electrical connector system is configured to be electrically connected to electrical terminals of another device.

8. The electrical connector system of claim 1, wherein the washer portion of the neck washer is configured to extend between a first layer of the piece of material and a second layer of the piece of material so that the electrical connection area is in electrical contact with an embedded portion of the electrical conductor extending in the lateral direction and in between the first and second layers of the piece of material.

9. The electrical connector system of claim 1, wherein the neck washer is made of electrically conductive material.

10. An active product comprising the electrical connector system according to claim 1.

11. The electrical connector system of claim 1, wherein an entirety of the neck portion is radially inward of the washer portion.

12. The electrical connector system of claim 1, wherein the neck portion of the neck washer and the male element are configured to clamp the loose end of the electrical conductor in the lateral direction to form the electrical connection area.

13. The electrical connector system of claim 1, wherein an entirety of the neck portion of the neck washer that extends in the longitudinal direction is arranged between the male element and the innermost radial surface of the female element in the lateral direction.

14. The electrical connector system of claim 1, wherein the washer portion of the neck washer is configured to electrically and directly contact a portion of the electrical conductor that extends in the lateral direction.

15. A system comprising:

a piece of material that extends generally along a lateral direction;

an electrical conductor that extends from the piece of material; and an electrical connector comprising a male element and female element configured to form a rivet for fastening the electrical connector to the piece of material, wherein the electrical connector further includes a neck washer comprising a washer portion and a neck portion, wherein the neck washer is monolithic so that the washer portion and the neck portion are physically interconnected, and wherein the neck washer is arranged between the male element and the female element of the rivet, wherein the electrical conductor comprises a loose end that extends from the piece of material along a longitudinal direction perpendicular to the lateral direction, wherein the loose end of the electrical conductor is clamped between the neck portion of the neck washer and the male element to form an electrical connection area configured to make electrical connection with the loose end of the electrical conductor of the piece of material, wherein, with the neck washer placed between the male element and the female element of the rivet:

the washer portion extends radially away from the male element and the neck portion, and the neck portion extends in the longitudinal direction from an opening in the piece of material through which the male element extends toward the female element, is radially inward of the washer portion and radially outward of the male element of the rivet, and is arranged directly between the male element and an innermost radial surface of the female element in the lateral direction, and wherein the neck portion of the neck washer is configured to electrically connect the electrical conductor to at least one of the male element and the female element.

16. The system of claim 15, wherein the electrical conductor further comprises an embedded portion, wherein the embedded portion is located between a first layer of the piece of material and a second layer of the piece of material, and wherein the loose end is coupled to the embedded portion of the electrical conductor.

17. The system of claim 16, wherein the washer portion of the neck washer is configured to electrically and directly contact the embedded portion of the electrical conductor.

18. The system of claim 15, wherein an entirety of the neck portion of the neck washer that extends in the longitudinal direction is arranged between the male element and the innermost radial surface of the female element in the lateral direction.

19. The system of claim 15, wherein the loose end of the electrical conductor is arranged directly between and directly contacts the male element and the neck portion of the neck washer in the lateral direction.

* * * * *